US005347722A

United States Patent [19]

Sefsick

[11] Patent Number: 5,347,722

[45] Date of Patent: Sep. 20, 1994

[54] ARCHERY BOWSIGHT

[76] Inventor: Stephen J. Sefsick, 6432 Angus Valley Dr., Wesley Chapel, Fla. 33544

[21] Appl. No.: 979,253

[22] Filed: Nov. 20, 1992

[51] Int. Cl.[5] ..... F41G 1/467

[52] U.S. Cl. ..... 33/265; 124/87

[58] Field of Search ..... 33/265; 124/87

[56] References Cited

U.S. PATENT DOCUMENTS

| | | | |
|---|---|---|---|
| 3,013,336 | 12/1961 | Pennington | 33/265 |
| 4,109,390 | 8/1978 | Smith et al. | 33/265 |
| 4,120,096 | 10/1978 | Keller | 33/265 |
| 4,418,479 | 12/1983 | Stachnik | 33/265 |
| 4,541,179 | 9/1985 | Closson | 33/265 |
| 4,580,349 | 4/1986 | Webb et al. | 33/265 |
| 4,616,422 | 10/1986 | Gaddy | 33/265 |
| 4,711,036 | 12/1987 | Morris | 33/265 |
| 4,720,919 | 1/1988 | Saunders | 33/265 |
| 4,884,347 | 12/1989 | Larson | 33/265 |
| 4,974,328 | 12/1990 | Lowry | 33/265 |
| 5,121,547 | 6/1992 | Littlejohn | 33/265 |

*Primary Examiner*—Thomas B. Will

[57] ABSTRACT

An archery bowsight, for use in a tree stand, or otherwise, to be fitted onto a compound bow, or other type bow, having a rotatable pendulum affixed inside a mounting framework, and the pendulum controlling the location of a free moving pin sight inside the framework, and therefore, in the path of the flight of the arrow, for instant and easy fixing on the target. A biasing counterweight arrangement on the pendulum corrects for different target distances, and an adjusting plate, affixed to the one side of the mounting framework, controls the fine tuned location of the pin sight, for high, or low misses, while bore sighting the archery bowsight. The archery bowsight also has a locating nut arrangement on the stem of the mounting screws to control the sideward location of the archery bowsight, to correct for side misses while bore sighting the archery bowsight. A locking screw arrangement extending upwards through the bottom of the mounting framework of the bowsight allows for locking the pendulum in a desired location for pre-determined distances, and a similar restricting screw arrangement extending downward from the top of the mounting framework restricts the movement of the pendulum for closer, downward shots. Also, a side mounted fixed pin sight plate can be mounted on the other side of the mounting framework, for mounting a series of fixed pin sights for pre-determined distances.

4 Claims, 3 Drawing Sheets

ARCHERY BOWSIGHT

BACKGROUND OF INVENTION

This invention relates to an apparatus and method of providing means for an archer to automatically choose the angle of flight of an arrow, this angle being continuously displayed to the archer, and adjusted to comply with the exact distance from the target, normally a deer, and, normally from a tree stand. The exact angle is calculated from a pendulum type sight, and is displayed to the archer by a pin sight, this pin sight being a part of this archery bowsight invention.

It has been customary for an archer hunter to find a certain area to hunt, and to build a tree stand in the area, climb to the tree stand, and wait for a deer to appear. These tree stands are very efficient, as it is seldom that a deer pays any attention to anything in the trees, as these are not a threat to the deer, animals on the ground being the natural enemy of the deer.

Now, shooting a bow from a tree stand is a very exacting shot for the archer. The normal shot being on a more or less level area, and the distance of travel of the arrow being more easily ascertained, than from a tree stand. These shots from a tree stand vary from a vertically downward shot to a distance of 70 yards. Therefore, the angle of the flight of the arrow conforms to the curvature of a mathematical equation for distance, time, velocity, and gravity, from angles of zero degrees to angles of some 110 degrees, and distances of from zero yards to some 70 yards. The normal archer is unable to attain any accuracy for shots of over 70 yards.

Several approaches have been provided for aiding the archer in sighting the arrow for these different distances. Holt, in U.S. Pat. No. 4,715,126 teaches a bow sight to be attached onto the mounting framework of a bow, and having several moveable pin sights within the archers sight, as he lines up the arrow on the target. These moveable pin sights have been placed within the archers sight in a pre sight bore trial, and, as a target is chosen, the archer determines mentally what the distance is, and chooses the pin sight which matches the distance to the target. These types of pin sights are very effective for known distances to the target, however, in a moment of excitement, determining the exact distance to the target becomes rather choicy, quickly, and is prone to human error.

Another approach is taught in the art of Johnson, in U.S. Pat. No. 4,846,141, whereby a framework is affixed to the bow, and again a series of pin sights are adjustably fitted within the sighting area of the archer, pre located to fit the bow, the archer, and the various distances to the target, and, the archer mentally determines the distance to the target, to the best of their ability, chooses the correct sighting pin, and releases the arrow. Here again, human error determines the exactness of the shot.

Still another approach is taught in the art of Lowry, in U.S. Pat. No. 4,974,328, whereby a Pendulum is used to correct for the actual distance to the target, allowing the archer to adjust a fixed pin sight attached to the pendulum, and, after bore sighting the bow, with the archers strength, the pin sight is fixed in that position relative to the pendulum. The problem with this fixed pin sight is that for different bows, the arrow trajectory will be different, and, these fixed pin sights will not readily adapt to these changes in arrow trajectory, again reverting the archer to a guess type of shot.

SUMMARY OF THE INVENTION

Accordingly, it is an object of this invention to provide a pendulum type of archery bowsight, and having a self adjusting pin sight, and the pin sight having the ability to automatically adapt to the equation for the amount of arrow drop, for different distances, the arrow velocity of different archers, different bows of different tensions, and, either from a tree stand, or, from a ground shot.

Another object of this invention is to provide this pendulum bowsight with an adjustments for bore sighting the bowsight, to correct for misses to either side of the target.

Another object of this invention is to provide this pendulum bowsight with an adjustment for correcting for misses too high, or, too low.

Yet another object of this invention is to provide a pendulum bowsight which allows the pendulum to control the position of the pin sight through the complete arc of the pendulum, thereby causing the controlled, free swinging pin sight to remain on the target throughout the entire arc of the pendulum, and, allowing the free swinging pin sight to compensate for the amount of arrow drop for all distances from 0 to 70 yards, as opposed to prior arts which only use the pendulum for bore sighting a fixed pin sight for particular distances.

Still another object of this invention is to provide this pendulum bowsight with an adjustment for zeroing in at a chosen distance, the distance being determined by the known area to be hunted.

Yet another object of this invention is to provide this pendulum bowsight with the ability to be fine tuned to a known target of known distance, at the longest projected distance, in this case, 70 yards.

In carrying out this invention in the illustrative embodiment thereof, a compound bow is fitted with the invention, the invention having a mounting framework to be mounted onto the compound bow, .and this mounting framework having two mounting screws permanently attached to one side of the mounting framework, and these two mounting screws being of a length to have two locating nuts screwed a desired distance onto the mounting screws, and then the mounting screws are fitted through accepting holes in the compound bow mounting device. After fitting the mounting screws through the accepting holes in the compound bow, the mounting framework is firmly attached to the compound bow by the use of retaining nuts, and washers being screwed tightly onto the outside of the mounting framework, thereby holding the mounting framework firmly to the compound bow, and, at a desired distance from the compound bow, and this distance being adjustable by the re-locating of the two locating nuts, and this adjustable distance being the correction apparatus for compensating for directing the arrow from one side of the target to the other, or, sideward bore sighting of the arrow. As the adjusting nuts are moved from inward to outward, and the mounting framework being correspondingly moved from side to side, the line of flight of the arrow is directed from right to left, or, left to right, as required.

Now, an adjusting plate is attached to the mounting framework, using the same mounting screws as was used to mount the mounting framework, and this adjusting plate having a longer vertical slot cut into its surface, and a shorter horizontal slot also cut into its surface. The longer vertical slot is used for mounting the adjusting plate onto the mounting framework, using two retaining nuts, and washers, but, the slot allowing for an upward, or downward adjustment of the plate onto the mounting framework. Now, as this adjusting plate is moved upward, or, downward, the shorter slot is moved the same distance, and becomes the upward, and downward bore sighting adjustment of the bowsight, as explained later.

Now, a pendulum is swingingly attached onto the inside of the mounting framework, and is allowed to swing freely, as the bowsight is aimed upward, or downward. Additionally, a counterweight is attached onto the pendulum, providing an adjustable bias to the swing limits of the pendulum. This bias is used for allowing free swinging of the pendulum for bore sighting the bowsight for different distances.

Freely attached to the pendulum is a moveable pin sight, this pin sight being comprised of a design not unlike a bicycle pedal arrangement, on a smaller scale, comprising a horizontal axle, a frontward extension, extending frontward at a 90 degree angle, and a rearward extension, extending rearward at a 90 degree angle from the horizontal axle, and this rearward extension having a colored, rounded material affixed at its outer end, for instant viewing of the pin and the target. Also, the frontward extending extension having itself a 90 degree outward bent section, at is outer end, and this outward bent section being fitted into the smaller slot in the adjusting plate, and this outward bent section being moved within the confines of the slot by the action of the pendulum, the axle being turnably fitted through an accepting hole in the pendulum. Appropriate bushings are provided on the outward bent section of the pin sight, and on the axle portion of the pin sight, to provide a free moving pin sight.

Now, as the compound bow is aimed upward, or downward, the pendulum swinging freely, and the pin sight movement controlled by the movement of the pendulum, the pin sight, after being completely bore sighted, will remain on the target through the various distances from the archer to the target.

The bore sighting is accomplished by setting several small targets at measured distances from the tree stand. The archer climbs to the tree stand, and picks a target at the central distance, and shoots an arrow at that target. The arrow will either be to the right, or left of the target, or, sometimes, on the target. If the arrow is left, or right of the target, the locating nuts on the bow mounting plate are adjusted inward, or outward, as the case may be, thereby correcting for the sideward travel of the arrow. The locating nuts are tightened, and the arrow will be on target for left or right correction.

Now, the arrow also can miss the target either high, or low, and, the pendulum can be swinging to a wrong position. Correction of the swing of the pendulum is made by adjusting the eccentric of the counterweight, on the pendulum. Also, the adjusting plate, having the smaller slot, is now adjusted upward, or downward, and this upward, or downward adjustment moves the location of the pin sight upward, or downward, in the opposite direction, thereby making the correction for a high, or low miss of the target for the chosen distance.

As a fine tuning adjustment of this bowsight, the archer aims at the farthest target, and shoots. Sometimes this arrow will miss either high or low. At this point, the adjusting plate is moved an additional distance upward, or downward, to correct for these minor, final, adjustments Several additional features are included in this invention. The above adjustments being for a tree stand. Now, when shooting on the ground, at known distances, an additional sighting plate is attached to the outer side of the archery bowsight, and this sighting plate has a slot cut in its surface. Several fixed pin sights can be attached into this slot, and bore sighted for known distances, and can be used instead of the moveable compensating pin sight. When using the tree stand, this sighting plate, with the fixed pin sights can be either removed, or, installed with the fixed pin sights turned outward, thereby removing any distraction from the archer.

Also, for these ground sighting shots, for known distances, a retaining pin, extending upward into the bottom of the mounting framework, and abutting the pendulum, locks the pendulum into a desired location, the bottom of the pendulum having a series of notches cut into its bottom peripheral.

As a final feature of the archery bowsight, an adjustment pin can be screwed downward through the top of the mounting framework a distance to restrict the movement of the pendulum upward, for close target, tree stand shots.

Conveniently, the user may mount this archery bowsight onto a compound bow, or, any bow, bore sight the bowsight for all distances within the range of the bow, and the archer, correct for side misses, correct for high, and low misses, and when a target appears, draw the bow with the pin sight on the target, and hit the target with consistency.

And, although this explanation of the archery bowsight is designed for a left handed archer, reversal of the mounting framework on a bow mounting plate will accommodate right handed archers also.

BRIEF DESCRIPTION OF THE DRAWINGS

This invention, together with other objects, features, aspects and advantages thereof, will be more clearly understood from the following description, considered in conjunction with the accompanying drawings.

Three sheets of drawings are furnished, sheet one contains FIG. 1 and FIG. 2, sheet two contains FIGS. 3, and 4, and sheet three contains FIGS. 5, 6, and 7.

DESCRIPTION OF THE PREFERRED EMBODIMENTS

Figure 1:
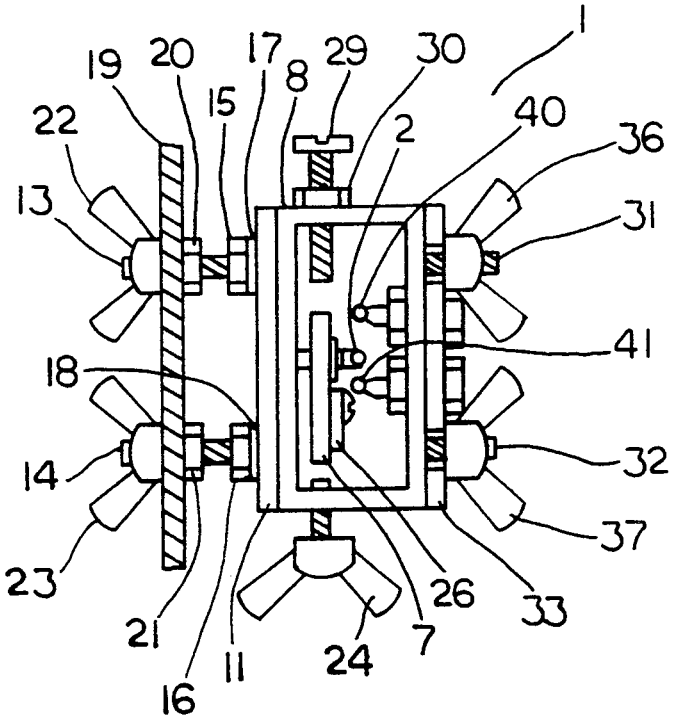
FIG. 1 is an elevation view of the invention, showing the various adjustments.

Referring now to FIG. 1, an archery bowsight, referred to generally by the reference numeral 1, is made of a suitable material to firmly hold all of the various components of the bowsight, and comprises a more or less rectangular mounting framework 8, framework 8 having provision for mounting a free swinging pendulum 7, which controls the position of a free swinging sighting pin 2, and sighting pin 2 having a luminous end piece for easy sighting on a target. Pendulum 7, and sighting pin 2 being the main sighting mechanism of the archery bowsight.

Figure 3:
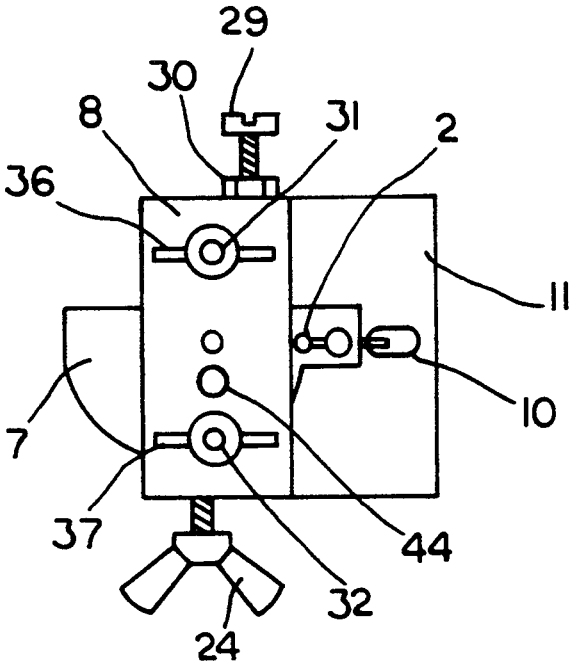
FIG. 3 is a side elevation view of the mounting framework, and the adjusting plate, and showing the action of the moveable pin sight.
Figure 4:
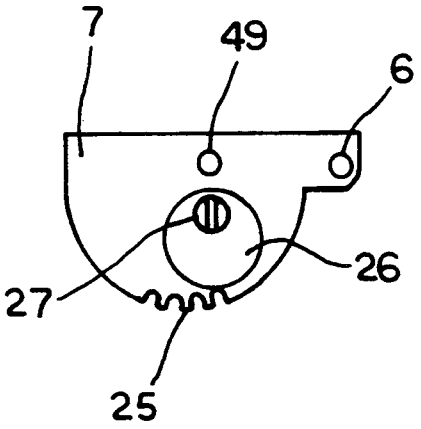
FIG. 4 is a side view of the pendulum, showing the notched bottom peripheral, and the counterweight.
Figure 7:
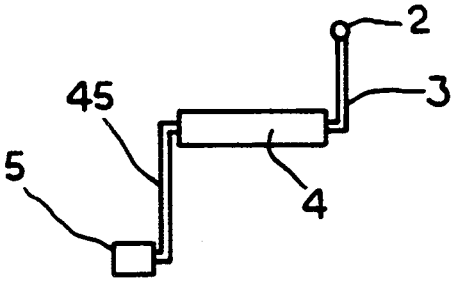
FIG. 7 is an end view of the moveable pin sight, showing the center axle, the two extending portions, the colored pin sight, and the bent end piece.

Now, and referring to FIG. 4, we see the side view of pendulum 7, and pendulum 7 having an adjustable counterweight 26, and adjustable counterweight 26 thereby providing a bias to the swing arc of pendulum 7. Pendulum 7 having a mounting hole 49 at its more or less upper central surface area, and an accepting hole 6, for accepting the center portion 4 of sighting pin 2, more easily seen in FIG. 7, center portion 4 of sighting pin 2 fitting through hole 6 of pendulum 7, thereby allowing extension 3 of sighting pin 2 to swing freely, under control of pendulum 7, and luminous end of sighting pin 2 to remain on the target as the arrow is aimed at the target. Now, extension 45 of sighting pin 2 having a bent end piece 5, and bent end piece 5 fitting loosely in a slot 10 of a final adjusting frame 11, adjusting frame 11, and slot 10 being more easily seen in FIG. 5. Pendulum 7 also having a series of notches 25, along its bottom peripheral, and notches 25 being used to lock pendulum 7 in a fixed position, using locking screw 24, more easily seen in FIG. 3, this fixing of pendulum 7 being used for walking through brush.

Referring now to FIG. 3, we see final adjusting frame 11 mounted on main frame 8, and locking screw 24 having provision to lock pendulum 7 in a fixed position. Also, and still referring to FIG. 3, we see sighting pin 2 being mounted through pendulum 7 by center bushing 4, outer bushing 5 being loosely fitted into slot 10, and the luminous end of sighting pin 2 being allowed to swing upward, or downward, to allow sighting pin 2 to remain on target at all times. Travel limit screw 29, having ability to restrict the total swinging arc of pendulum 2, for use in extreme downward shots of the bow, and travel limit screw 29 being lockable in place by lock nut 30. Wing nuts 36, and 37 being available for mounting side plate 33.

Figure 2:
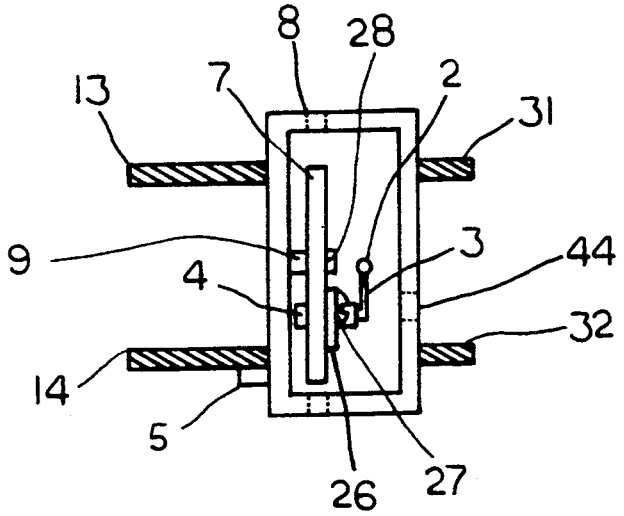
FIG. 2 is an elevation view of the mounting framework, and, the pendulum and the pin sight.
Figure 5:
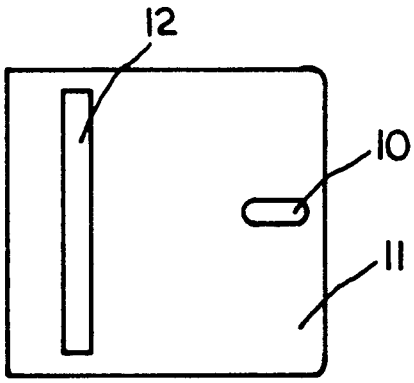
FIG. 5 is a side view of the adjusting plate, showing the longer mounting, and adjusting slot, and the shorter slot, for accepting the bent end of the moveable pin sight.

Now, and referring specifically to FIG. 5, frame 11 having mounting slot 12, slot 12 being used to adjustably mount frame 11 onto mounting frame 8, using upper mounting screw 13, and lower mounting screw 14, more easily seen in FIG. 2, frame 11 also having slot 10 for loosely accepting outer bushing 5 of sighting pin 2.

Figure 6:
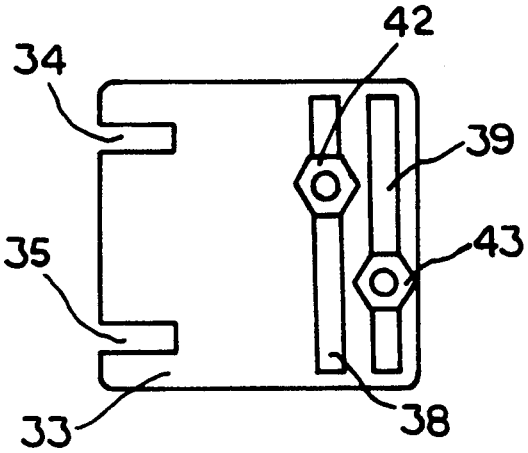
FIG. 6 is a side view of the fixed pin sight mounting plate, showing the lock nuts for the fixed pin sights.

Now, and referring specifically to FIG. 2, we see an archers view of mounting frame 8, pendulum 7 being swingingly mounted onto framework 8 by bearing pin 9, and pendulum 7 being held swingingly in place by retaining washer 28. Also, we see counterweight 26 being adjustably mounted onto pendulum 7 by adjusting screw 27, and access to adjusting screw 27 being provided through access hole 44, pendulum 7 controlling the position of sighting pin 2, to insure sighting pin 2 remains on target throughout the swinging arc of pendulum 7. Also, and still referring to FIG. 2, framework 8 having an upper mounting screw 31, and a lower mounting screw 32 extending from the side surface of framework 8, and these mounting screws 31, and 32 being used to mount a right side plate 33 which mounts an array of adjustably fixed sights 40, and 41, this mounting arrangement more easily seen in FIG. 6. Still referring to FIG. 6, we see the two mounting slots 34, and 35 to be fitted over the two mounting screws 31, and 32, of frame 8, thereby securing the right side plate 33 to framework 8.

Now, two adjusting slots 38, and 39, in right side plate 33, provide means for adjustably mounting the array of fixed sights 40, and 41, using mounting nuts 42, and 43.

Referring back to FIG. 1, we see mounting framework 8, adjustably attached to bow mounting hardware 19, upper locking nut 20, and lower locking nut 21 controlling the amount of distance from bow mounting hardware 19, and frame 11, and this distance controlling the amount of side travel of the arrow to the target, and this distance being adjusted accordingly, when bore sighting the bow. After bore sighting the bow, and arrow, frame 8 is final affixed onto bow mounting plate 19, using locking nuts 22, and 23, and final adjusting plate 11 is adjustably attached to frame 8 by locking nuts 15, and 16, and washers 17, and 18, and mounting screws 13, and 14.

Accordingly, a very unique, attractive, convenient method and apparatus are provided for mounting an archery bow sight onto a compound bow, or other type, adjustably bore sighting the bow to the archers shooting habits, for target ranges from 0 to 70 yards, normally, and, using the pendulum controlled sighting pin of the bowsight, keep the luminous pin, and the arrow, on the target throughout all of the distances, and angles, the bowsight compensating for the various amounts of drop of the arrow throughout the distance of travel of the arrow.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit .and scope of this invention as claimed in the following claims and reasonable equivalents to the claimed elements.

What is claimed is:

1. An archery bowsight having a series of sighting adjustments, and a pendulum controlled pin sight for consistent hitting of a target at distances from 0 to 70 yards, either from a tree stand, or from a ground shot, comprising:

a basic mounting framework having left and right spaced apart sides, a top and a bottom, to be affixed to a bow, and said mounting framework having mounting means for:

an adjusting plate, a pendulum, a moveable pin sight, and a fixed pin sight array, said adjusting plate being affixed onto one side of said mounting framework and said adjusting plate having an elongated adjustable mounting slot, said adjustable mounting slot providing vertical upwards, or downwards adjustment of said plate on said mounting framework, and said adjusting plate also having a smaller slot, said smaller slot providing adjustable biasing means for partially controlling the action of said moveable pin sight, said moveable pin sight having a central axle portion, and two radial extending arms extending a distance from said central axle portion, in diametrically opposed directions, defining a forward radial arm and a rearward radial arm, said forward radial arm having a 90 degree bend in its extreme end, and said 90 degree bend fitting slideingly into said smaller slot of said adjusting plate, said smaller slot thereby providing said adjustable biasing means to control the amount of movement of said forward radial arm of said moveable pin sight, said rearward radial arm having an amount of fluorescent, or highly visible material, affixed onto its extreme outer end, a pendulum, said pendulum being rotatably affixed onto the same side of said mounting framework as said adjusting plate, and inside the peripheral of said mounting framework, said pendulum having an adjustable counterweight attached onto its lateral surface, and said adjustable counterweight providing biasing means for biasing the swing of said pendulum from one side of its arc to the other side of its arc, said axle portion of said moveable pin sight being rotatably fitted through an accepting hole in said pendulum, whereby said pendulum provides turntable mounting means for said moveable pin sight said axle of said moveable pin sight thereby cooperating with the forward radial arm of said moveable pin sight, thereby providing more or less vertical upwardly, and vertical downwardly movement to said rearward radial arm of said moveable pin sight, and said movement of said rearward radial arm, thereby providing means for an archer to easily, and accurately follow, or, pin point a target.

2. An archery bowsight as stated in claim 1, having a restricting screw, said screw extending upwards through said bottom of said mounting framework, and having means to be abutted against a bottom peripheral of said pendulum, thereby locking said pendulum in a pre-positioned location, providing means for instant aiming of said pin sight at targets at pre-determined distances.

3. An archery bowsight as stated in claim 1 having pendulum locking means, said means being a screw extending through said top of said mounting framework, and mating with an edge of said pendulum, and thereby locking said pendulum in a desired position, and providing means for aiming said pin sight for pre-determined distance targets.

4. An archery bowsight as stated in claim 1 having an adjustable fixed pin sight mounting plate affixed to the other side surface of said mounting framework opposite from said adjusting plate, and affixed on the outside of said mounting framework, said fixed pin sight mounting plate providing adjustable mounting means for a plurality of fixed pin sights, said fixed pin sights providing aiming means for pre-determined distances, each of said plurality of fixed pin sights being affixed in a pre-determined location on said fixed pin sight mounting plate, and each said fixed pin sight affixed for a specific fixed distance of travel of an arrow to the target.

* * * * *